US011099498B2

(12) United States Patent
Konishi

(10) Patent No.: US 11,099,498 B2
(45) Date of Patent: Aug. 24, 2021

(54) IMAGE FORMING APPARATUS

(71) Applicant: KYOCERA Document Solutions Inc., Osaka (JP)

(72) Inventor: Hiroto Konishi, Osaka (JP)

(73) Assignee: Kyocera Document Solutions, Inc.

( * ) Notice: Subject to any disclaimer, the term of this patent is extended or adjusted under 35 U.S.C. 154(b) by 0 days.

(21) Appl. No.: 17/069,229

(22) Filed: Oct. 13, 2020

(65) Prior Publication Data

US 2021/0116834 A1 Apr. 22, 2021

(30) Foreign Application Priority Data

Oct. 17, 2019 (JP) ..... JP2019-189954

(51) Int. Cl.
*G03G 15/043* (2006.01)
*G03G 15/00* (2006.01)

(52) U.S. Cl.
CPC ..... *G03G 15/043* (2013.01); *G03G 15/50* (2013.01)

(58) Field of Classification Search
CPC .. G03G 15/0415; G03G 15/043; G03G 15/50; G03G 15/065
See application file for complete search history.

(56) References Cited

U.S. PATENT DOCUMENTS

2008/0170870 A1* 7/2008 Yamaguchi ..... G03G 15/326 399/49
2009/0176171 A1* 7/2009 Ogawa ..... G03G 15/0131 430/120.1

FOREIGN PATENT DOCUMENTS

JP 2018-072491 5/2018

* cited by examiner

*Primary Examiner* — Hoang X Ngo

(57) ABSTRACT

In an image forming apparatus, an exposure device irradiates a real latent image line position with scanning light in a primary scanning direction and thereby forms an electrostatic latent image at the real latent image line position, and irradiates two real latent image line positions with scanning light in a primary scanning direction and thereby forms an electrostatic latent image at an imaginary latent image line position between the two real latent image line positions. A controller adjusts light emitting time per dot in the exposure device for the real latent image line positions irradiated to form the electrostatic latent image at the imaginary latent image line position, on the basis of a development potential difference corresponding to a development bias voltage of the development device that has been adjusted in calibration and a surface potential of an exposure area on a photoconductor drum.

4 Claims, 7 Drawing Sheets

IMAGE FORMING APPARATUS

CROSS-REFERENCE TO RELATED APPLICATIONS

This application relates to and claims priority rights from Japanese Patent Application No. 2019-189954, filed on Oct. 17, 2019, the entire disclosures of which are hereby incorporated by reference herein.

BACKGROUND

1. Field of the Present Disclosure

The present disclosure relates to an image forming apparatus.

2. Description of the Related Art

In an electrophotographic image forming apparatus, development characteristics change due to surrounding environmental change or the like, and therefore, the electrophotographic image forming apparatus performs calibration. In calibration, an image forming apparatus estimates a toner height in a toner adhesion area on the basis of a development condition, and performs adjustment of an image forming condition on the basis of the estimated toner height and a sensor output value of a toner adhesion amount.

Meanwhile, in an image forming apparatus, an interleave-scanning manner is applied as a pseudo resolution enhancement method. In the pseudo resolution enhancement method, a laser beam is physically scanned at a real latent image line position, and thereby an electrostatic latent image is formed at an imaginary latent image line position between two real latent image line positions. Thus, an electrostatic latent image at an imaginary latent image line position is formed without physically scanning a laser beam at the imaginary latent image line position.

For example, regarding a thin line or a dot of about one-dot width at an imaginary latent image line position, two real latent image line positions adjacent to the imaginary latent image line position are exposed with a low light amount, and thereby an electrostatic latent image of the thin line or the dot of about one-dot width is formed at the imaginary latent image line position.

In the calibration mentioned above, patch images (solid images) are developed with toner, a development bias voltage is adjusted, and thereby a density adjustment of a toner image is performed. However, as mentioned, an electrostatic latent image of a thin line or a dot of one-dot width at an imaginary latent image line position is formed by exposing the aforementioned two adjacent real latent image line positions with a low light amount that is different from a light amount for a solid image at real latent image line position, and consequently, such thin line or dot at an imaginary latent image line position may not be formed with a proper width.

SUMMARY

An image forming apparatus according to an aspect of the present disclosure includes a photoconductor drum, an exposure device configured to irradiate the photoconductor drum with light and thereby form an electrostatic latent image, a development device configured to cause toner to adhere to the electrostatic latent image and thereby generate a toner image, and a controller configured to control the exposure device. Further, the exposure device irradiates a real latent image line position with the light scanning in a primary scanning direction and thereby forms an electrostatic latent image at the real latent image line position, and irradiates two real latent image line positions with the light scanning in a primary scanning direction and thereby forms an electrostatic latent image at an imaginary latent image line position between the two real latent image line positions. The controller adjusts light emitting time per dot in the exposure device for the real latent image line positions irradiated to form the electrostatic latent image at the imaginary latent image line position, on the basis of a development potential difference corresponding to a development bias voltage of the development device that has been adjusted in calibration and a surface potential of an exposure area on the photoconductor drum.

These and other objects, features and advantages of the present disclosure will become more apparent upon reading of the following detailed description along with the accompanied drawings.

DETAILED DESCRIPTION

Hereinafter, an embodiment according to an aspect of the present disclosure will be explained with reference to drawings.

Figure 1:
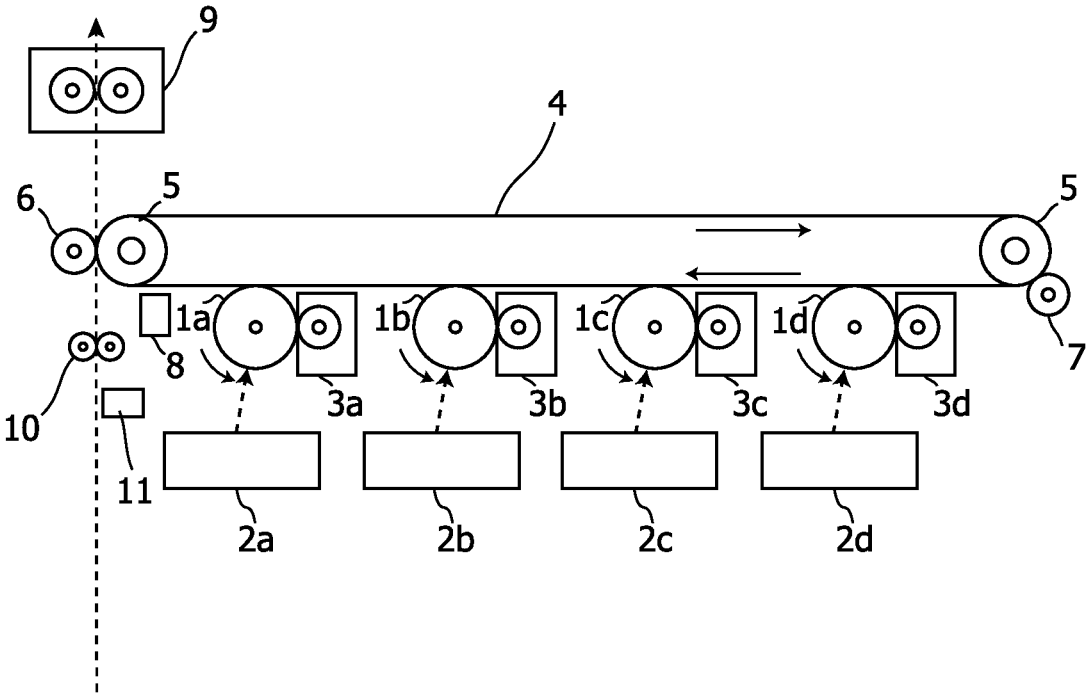
FIG. 1 shows a side view that indicates an internal mechanical configuration of an image forming apparatus in an embodiment according to the present disclosure.

FIG. 1 shows a side view that indicates an internal mechanical configuration of an image forming apparatus in an embodiment according to the present disclosure. The image forming apparatus shown in FIG. 1 is an apparatus having an electrophotographic printing function, such as a printer, a facsimile machine, a copier or a multi function peripheral.

The image forming apparatus in this embodiment includes a tandem-type color development device. This color development device includes photoconductor drums 1*a* to 1*d*, exposure devices 2*a* to 2*d*, and development devices 3*a* to 3*d*. The photoconductor drums 1*a* to 1*d* are photoconductors of four toner colors: Cyan, Magenta, Yellow and Black.

The exposure devices 2*a* to 2*d* irradiate the photoconductor drums 1*a* to 1*d* with laser light and thereby form electrostatic latent images. Each of the exposure devices 2*a* to 2*d* includes a laser diode as a light source of the laser light, optical elements (such as lens, mirror and polygon mirror) that guide the laser light to the photoconductor drum 1*a*, 1*b*, 1*c*, or 1*d*.

Further, the periphery of each one of the photoconductor drums 1*a* to 1*d* includes a charging unit such as scorotron, a cleaning device, a static electricity eliminator and the like. The cleaning device removes residual toner on each one of the photoconductor drums 1*a* to 1*d* after primary transfer. The static electricity eliminator eliminates static electricity of each one of the photoconductor drums 1*a* to 1*d* after primary transfer.

Toner cartridges which contain toner of four colors: Cyan, Magenta, Yellow and Black are attached to the development devices 3*a* to 3*d*, respectively. In the development devices 3*a* to 3*d*, the toner is supplied from the toner cartridges, and this toner and carrier compose developer. The development devices 3*a* to 3*d* causes the toner to adhere to the photoconductor drums 1*a* to 1*d* and thereby forms toner images.

The photoconductor drum 1*a*, the exposure device 2*a* and the development device 3*a* perform development of Magenta. The photoconductor drum 1*b*, the exposure device 2*b* and the development device 3*b* perform development of Cyan. The photoconductor drum 1*c*, the exposure device 2*c* and the development device 3*c* perform development of Yellow. The photoconductor drum 1*d*, the exposure device 2*d* and the development device 3*d* perform development of Black.

The intermediate transfer belt 4 is a loop-shaped image carrier, and contacts the photoconductor drums 1*a* to 1*d*. Toner images on the photoconductor drums 1*a* to 1*d* are primarily transferred onto the intermediate transfer belt 4. The intermediate transfer belt 4 is hitched around driving rollers 5, and rotates by driving force of the driving rollers 5 towards the direction from the contact position with the photoconductor drum 1*d* to the contact position with the photoconductor drum 1*a*.

A transfer roller 6 causes an incoming paper sheet in transportation to contact the transfer belt 4, and secondarily transfers the toner image on the transfer belt 4 to the paper sheet. The printing sheet on which the toner image has been transferred is transported to a fuser 9, and consequently, the toner image is fixed on the printing sheet.

A roller 7 has a cleaning brush, and removes residual toner on the intermediate transfer belt 4 by contacting the cleaning brush to the intermediate transfer belt 4 after transferring the toner image to the paper sheet.

A sensor 8 is an optical sensor that measures a density of a developed toner patch image in the calibration, and irradiates the intermediate transfer belt 4 with a light beam and detects its reflected light. For example, for adjustment of a toner density in the calibration, the sensor irradiates a predetermined area (toner patch image or surface material of the intermediate transfer belt 4) on the intermediate transfer belt 4, detects its reflected light, and outputs an electric signal corresponding to a light amount of the reflected light.

A registration roller 10 temporarily stops the incoming printing sheet transported from a paper sheet feeding tray or the like, and at a second feeding timing, transports the printing sheet to a transfer position between the intermediate transfer belt 4 and the transfer roller 6. The second feeding timing is specified so as to cause a toner image on the intermediate transfer belt 4 to be transferred to a specified position on the printing sheet. A registration sensor 11 is a sensor that is arranged near the registration roller 10, and optically detects that a printing sheet reaches the registration roller 10 (i.e. registration position).

Figure 2:
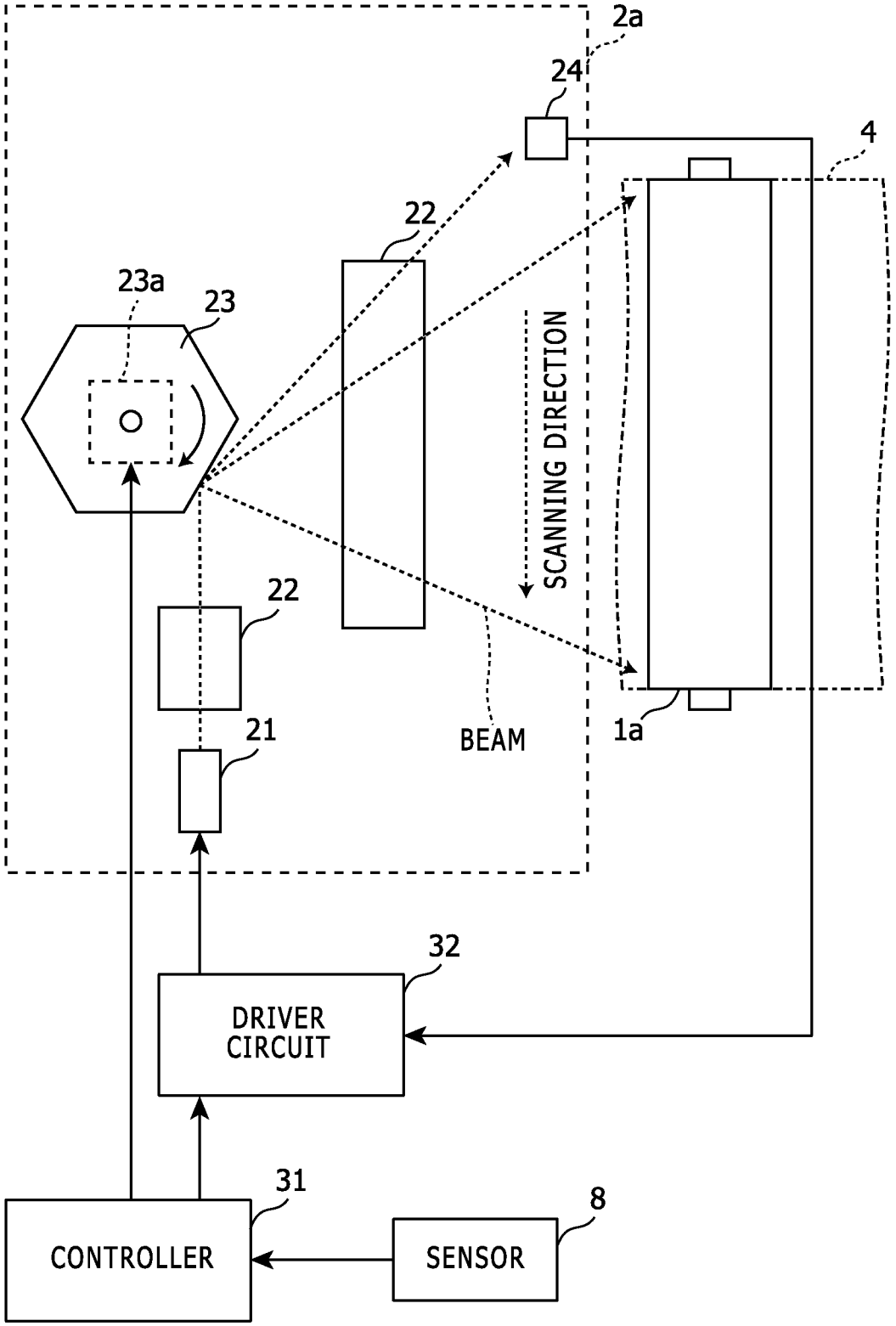
FIG. 2 shows a diagram that indicates an example of a configuration of an exposure device 2*a* shown in FIG. 1 and a configuration of its peripheral electronic circuit.

FIG. 2 shows a diagram that indicates an example of a configuration of an exposure device 2*a* shown in FIG. 1 and a configuration of its peripheral electronic circuit. The exposure device shown in FIG. 2 is the exposure device 2*a* for the photoconductor drum 1*a*, and the exposure devices 2*b* to 2*d* for the photoconductor drums 1*b* to 1*d* has the same configuration.

In FIG. 2, a laser diode 21 is a light source that emits the laser light. An optical system 22 includes lenses arranged from the laser diode 21 to a polygon mirror 23 and/or from the polygon mirror 23 to the photoconductor drum 1*a* and a PD sensor 24. As the optical system 22, f-Theta lens or the like is used.

Further, the polygon mirror 23 is an element that includes an axis perpendicular to an axis of the photoconductor drum 1*a*, has a polygonal cross section perpendicular to the own axis, and has side surfaces that form mirrors. The polygon mirror 23 rotates around the own axis, and scans the laser light emitted from the laser diode along an axis direction of the photoconductor drum 1*a* (i.e. along a primary scanning direction).

A polygon motor unit 23*a* causes the polygon mirror 23 to rotate in accordance with a control signal supplied from a controller 31.

Further, the PD sensor 24 is a sensor that receives at a predetermined position the laser light scanned by the polygon mirror 23 to generate a primary scanning directional synchronization signal. When light enters the PD sensor 24, the PD sensor 24 induces an output voltage corresponding to an amount of the light. The PD sensor 24 is arranged at a predetermined position on a line on which the light is scanned, detects a timing that a spot of the light passes through this position, and outputs as the primary scanning directional synchronization signal a pulse formed at this timing.

The controller 31 includes an ASIC (Application Specific Integrated Circuit), a computer and/or the like and performs control of an internal device of this image forming apparatus, a data process and the like, and controls the exposure device 2*a* (the laser diode 21, a driver circuit 32 and the like) and thereby exposures the photoconductor drum 1*a* with the laser light from the exposure device 2*a* for image forming.

The driver circuit 32 is a circuit that controls the laser diode 21 and thereby causes the laser diode 21 to emit the laser light. The driver circuit 32 controls the laser diode 21 in synchronization with the primary scanning directional synchronization signal so as to expose with the laser light a pattern corresponding to an image to be formed.

Figure 3:
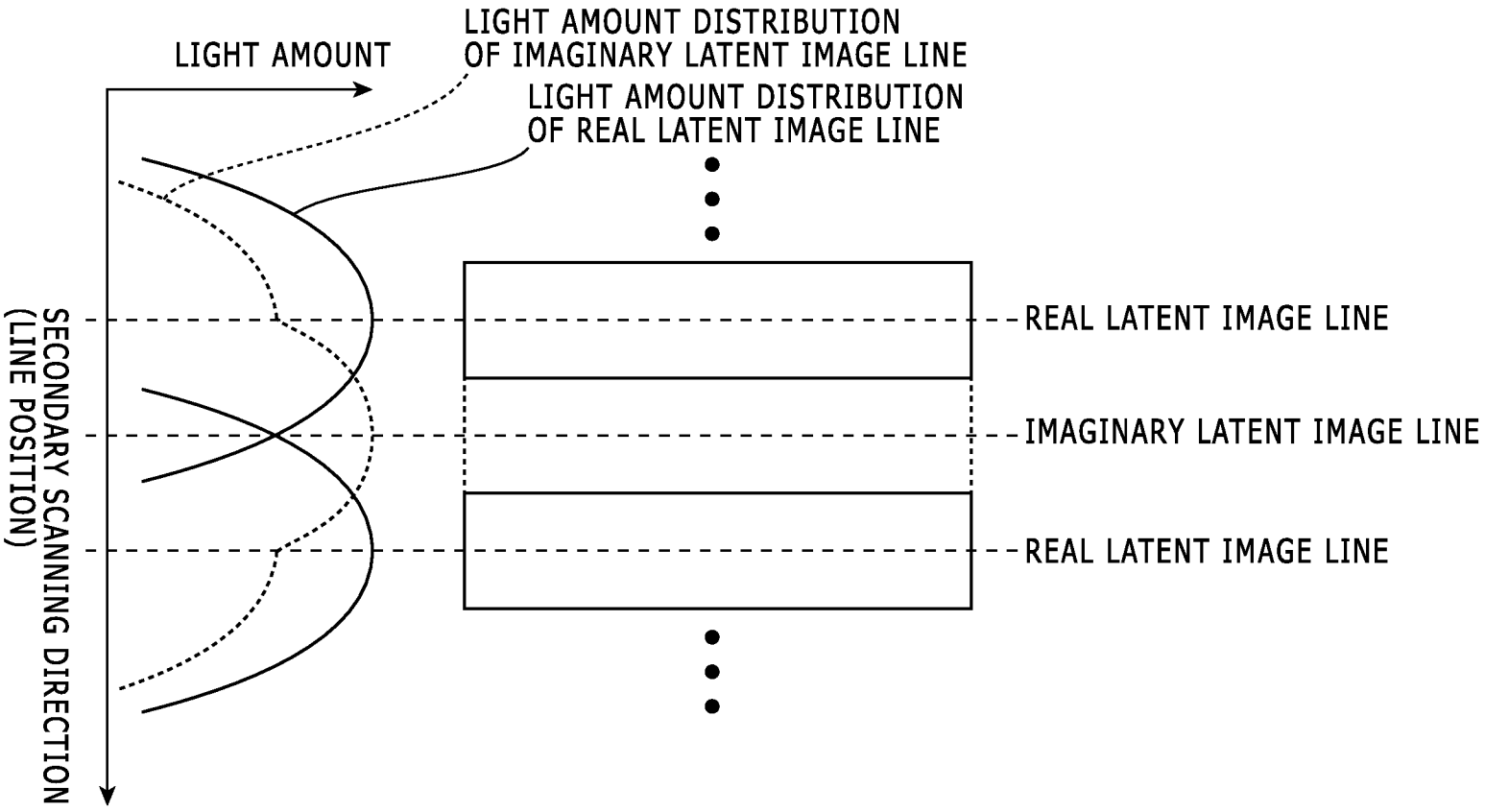
FIG. 3 shows a diagram that explains a pseudo resolution enhancement technique.

FIG. 3 shows a diagram that explains a pseudo resolution enhancement technique. As shown in FIG. 3, the exposure device 2*a* forms an electrostatic latent image using a pseudo resolution enhancement technique. Specifically, the exposure device 2*a* irradiates a real latent image line position with the laser light and thereby forms an electrostatic latent image at the real latent image line position, and irradiates two real latent image line positions with the laser light and thereby forms an electrostatic latent image at an imaginary latent image line position between the two real latent image line positions. It should be noted that a light amount (i.e. strength or irradiation time) of the laser light at the real latent image line position is adjusted so as to enable to develop a toner image at the imaginary latent image line position without development of a toner image at the real latent image line positions.

Figure 4:
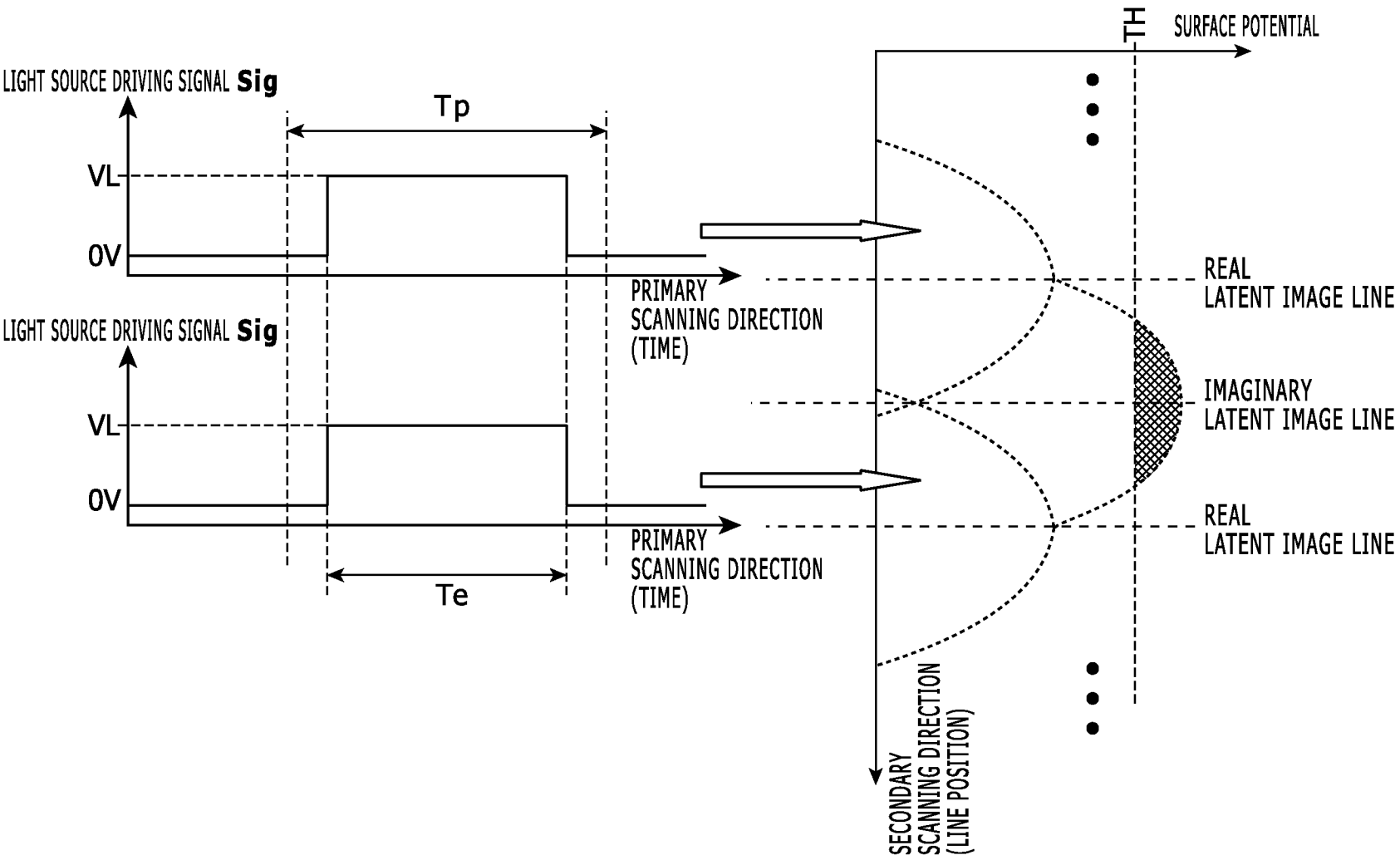
FIG. 4 shows a diagram that explains a driving signal for driving a light source (laser diode 21) of an exposure device 2*a*, 2*b*, 2*c* or 2*d* when forming a thin line or dot at an imaginary latent image line position in the image forming apparatus shown in FIGS. 1 to 3.

FIG. 4 shows a diagram that explains a driving signal for driving a light source (laser diode 21) of an exposure device 2*a*, 2*b*, 2*c* or 2*d* when forming a thin line or dot (of one-dot width) at an imaginary latent image line position in the image forming apparatus shown in FIGS. 1 to 3.

For example, when a solid image is formed at a real latent image line position, the driver circuit 32 applies a driving signal Sig to the laser diode 21 in accordance with a command from the controller 31, and thereby causes the light source (the laser diode 21) to emit the light during all sections of time Tp per pixel.

Contrarily, for example, when a thin line or a dot is formed at an imaginary latent image line position, in order to form an electrostatic latent image at the imaginary latent image line position without forming an electrostatic latent image at adjacent real latent image line positions, the driver circuit 32 applies a driving signal Sig to the laser diode 21 in accordance with a command from the controller 31, and thereby causes the light source (the laser diode 21) to emit the light during time Td that is a part of the time Tp, rather than during all sections of the time Tp per pixel. Consequently, at the adjacent real latent image line positions, a surface potential of the photoconductor drum 1*a*, 1*b*, 1*c* or 1*d* gets less than a threshold value TH (that is a surface potential required to form a toner image); but at the imaginary latent image line position, a surface potential of the photoconductor drum 1*a*, 1*b*, 1*c* or 1*d* exceeds the threshold value TH due to exposure of the two adjacent real latent image line positions.

Further, when a predetermined condition is satisfied, the controller 31 perform calibration, and thereby adjusts development bias voltages of the development devices 3*a* to 3*d* (i.e. potentials of development rollers facing to the photoconductor drums 1*a* to 1*d*, or the like), and adjusts applied voltages to light sources (the laser diode 21) of the exposure devices 2*a* to 2*d* (i.e. surface potentials of the photoconductor drums 1*a* to 1*d* when performing the exposure for an image having a specific density). In the calibration, patch images are formed under plural conditions on setting items such as exposure light amount and development bias voltage, and the exposure light amount, the development bias voltage and the like are adjusted on the basis of density measurement values of the patch images so as to obtain proper densities and proper gradation of a toner image.

Furthermore, the controller 31 adjusts light emitting time Te per dot in the exposure device 2*a*, 2*b*, 2*c* or 2*d* for the real latent image line positions irradiated to form the electrostatic latent image at the imaginary latent image line position, on the basis of a development potential difference dV (=Vd−Vs) corresponding to a development bias voltage Vd of the development device 3*a*, 3*b*, 3*c* or 3*d* that has been adjusted in calibration and a surface potential of an exposure area on the photoconductor drum 1*a*, 1*b*, 1*c* or 1*d*.

Specifically, the controller 31 derives a correction amount dT corresponding to the aforementioned development potential difference dV using a predetermined formula or table that indicates a relationship determined in advance in an experiment or the like, and adjusts the light emitting time Te on the basis of the correction amount dT.

Figure 5:
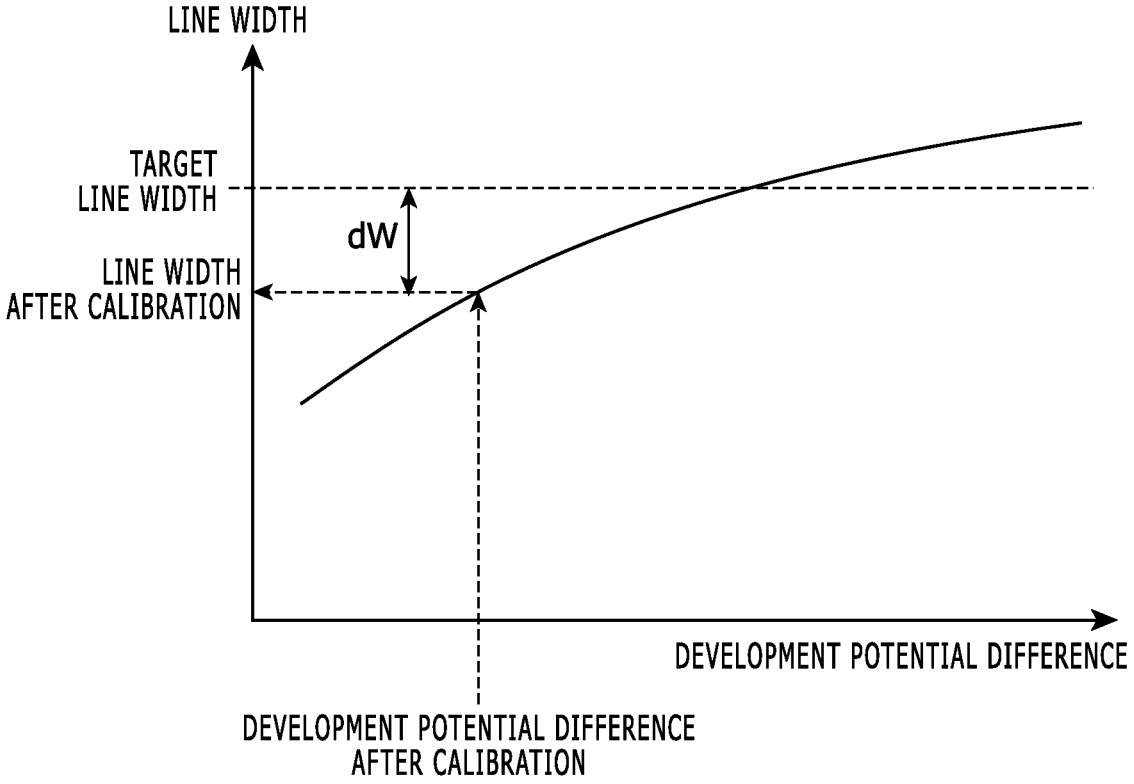
FIG. 5 shows a diagram that explains a relationship between a development potential difference dV and a line width error dW.
Figure 6:
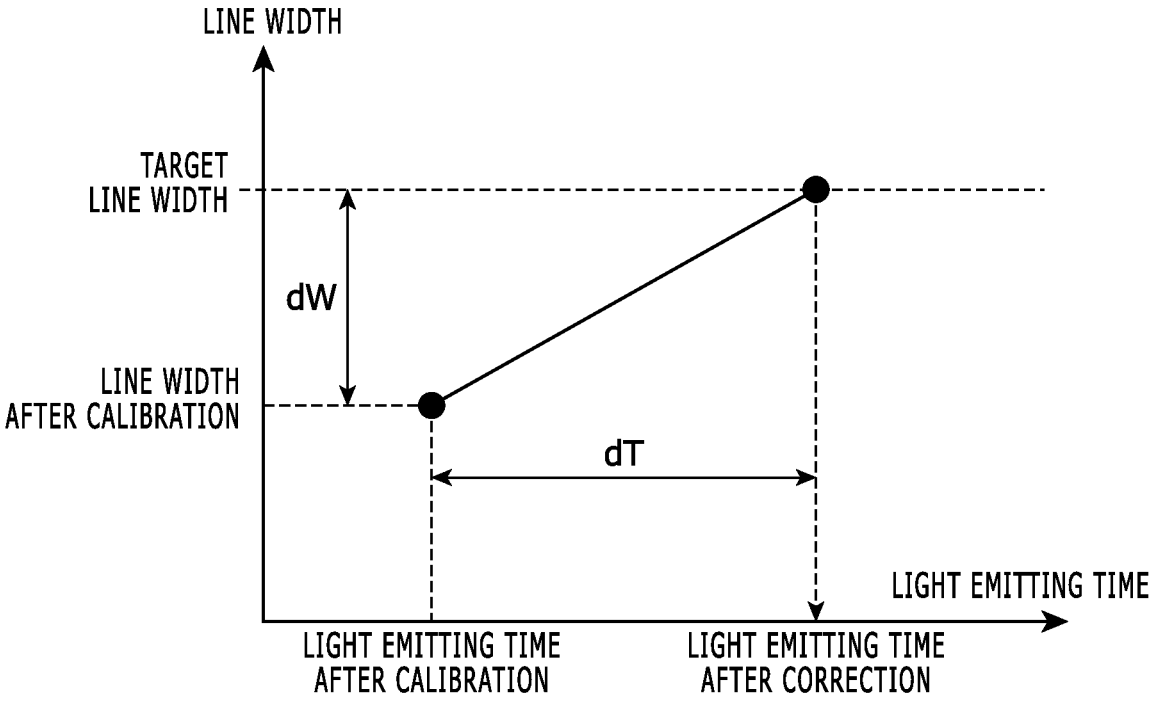
FIG. 6 shows a diagram that explains a relationship between the line width error dW and a correction amount dT of light emitting time.

FIG. 5 shows a diagram that explains a relationship between a development potential difference dV and a line width error dW. FIG. 6 shows a diagram that explains a relationship between the line width error dW and a correction amount dT of light emitting time. For example, on the basis of a relationship shown in FIGS. 5 and 6, a line width error dW (i.e. an error from a goal line width) is determined corresponding to a development potential difference dV, a correction amount dT is determined corresponding to the line width error dW, and the light emitting time Te is corrected by adding the correction amount dT to the light emitting time Te (i.e. Te=Te+dT).

Here, the controller 31 determines an applied voltage VL to the light source (the laser diode 21) of the exposure device 2*a*, 2*b*, 2*c* or 2*d* that has been adjusted in the calibration, and adjusts the aforementioned light emitting time on the basis of the development potential difference dV corresponding to the development bias voltage Vd and the surface potential corresponding to the applied voltage.

Figure 7:
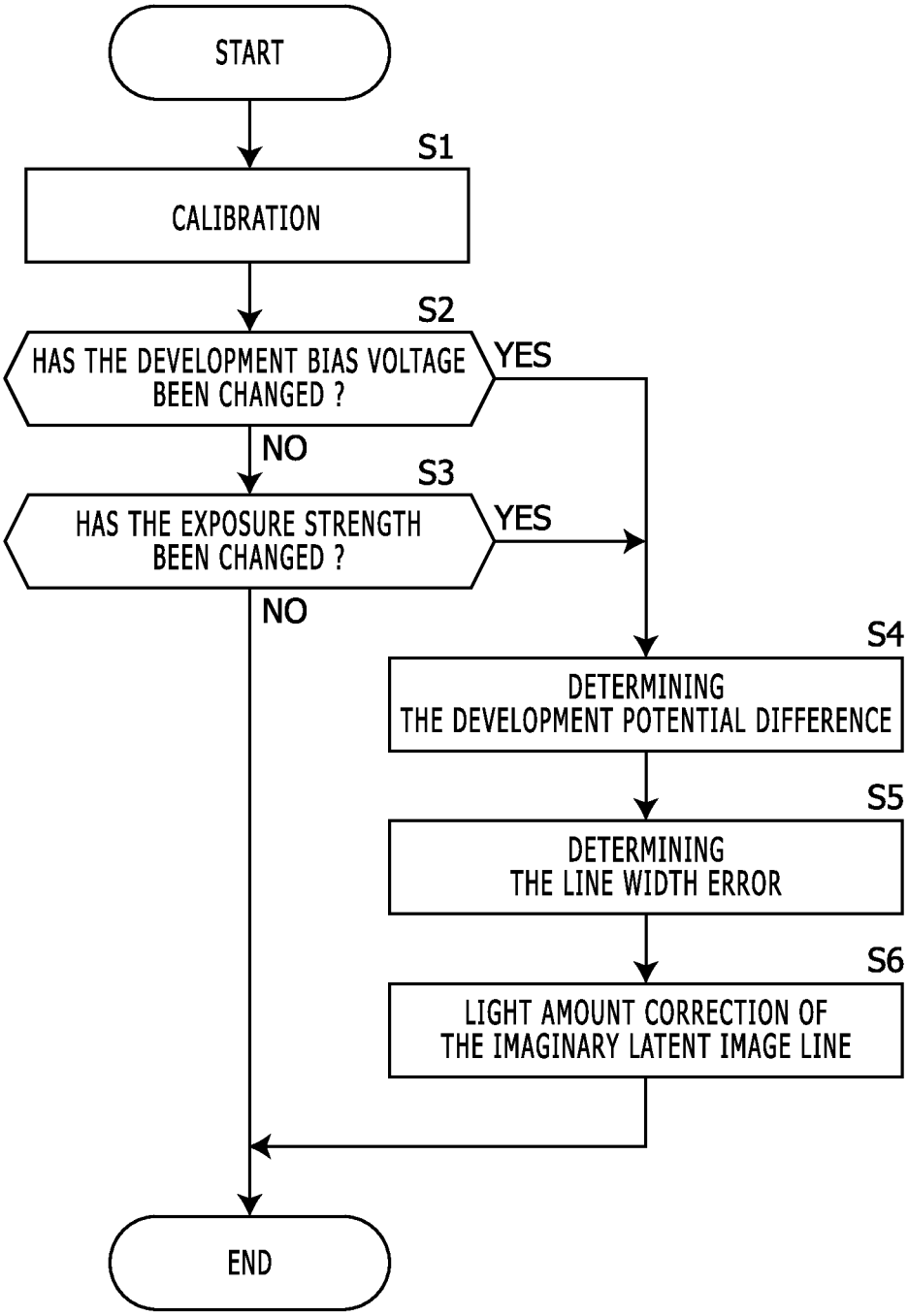
FIG. 7 shows a flowchart that explains a behavior of the image forming apparatus shown in FIG. 1.

The following part explains a behavior of the aforementioned image forming apparatus. FIG. 7 shows a flowchart that explains a behavior of the image forming apparatus shown in FIG. 1.

The controller 31 performs calibration at a predetermined timing, and adjusts the development bias voltage Vd, the exposure strength (i.e. the applied voltage VL) and the like, if needed (in Step S1).

Further, the controller 31 determines whether the development bias voltage Vd and/or the exposure strength (the applied voltage VL) have/has been changed in the calibration or not (in Steps S2 and S3).

If the development bias voltage Vd and/or the exposure strength (the applied voltage VL) have/has been changed, the controller 31 determines a surface potential Vs corresponding to the exposure strength (the applied voltage VL), and determines a development potential difference Vd from the development bias voltage Vd and the surface potential Vs (in Step S4).

Subsequently, the controller 31 determines a line width error dW corresponding to the development potential difference Vd (in Step S5), determines a correction amount dT corresponding to the line width error dW, and corrects the light emitting time Te per dot at an imaginary latent image line position with the correction amount dT (in Step S6). After this correction, when printing a user image or the like, in order to form a thin line or a dot at an imaginary latent image line position, the exposure is performed with the corrected light emitting time Te.

As mentioned, in the aforementioned embodiment, the exposure device 2*a*, 2*b*, 2*c* or 2*d* irradiates a real latent image line position with light and thereby forms an electrostatic latent image at the real latent image line position, and irradiates two real latent image line positions with light and thereby forms an electrostatic latent image at an imaginary latent image line position between the two real latent image line positions. Further, the controller 31 adjusts light emitting time Te per dot in the exposure device 2*a*, 2*b*, 2*c* or 2*d* for the real latent image line positions irradiated to form the electrostatic latent image at the imaginary latent image line position, on the basis of a development potential difference dV corresponding to a development bias voltage Vd of the development device 3*a*, 3*b*, 3*c* or 3*d* that has been adjusted in calibration and a surface potential Vs of an exposure area on the photoconductor drum 1*a*, 1*b*, 1*c* or 1*d*.

Consequently, an exposure light amount is properly set for forming a thin line or a dot at an imaginary latent image line position in an interleave-scanning manner, and a thin line or a dot at an imaginary latent image line position is formed of a proper width in an interleave-scanning manner.

It should be understood that various changes and modifications to the embodiments described herein will be apparent to those skilled in the art. Such changes and modifications may be made without departing from the spirit and scope of the present subject matter and without diminishing its intended advantages. It is therefore intended that such changes and modifications be covered by the appended claims.

For example, in the aforementioned embodiment, the controller 31 may determine an electric charge amount of the toner, and adjust the aforementioned light emitting time on the basis of the electric charge amount. In such a case, when the toner electric charge amount (positive electric charge) is increased, the aforementioned light emitting time is shortened.

What is claimed is:

1. An image forming apparatus, comprising:

a photoconductor drum;

an exposure device configured to irradiate the photoconductor drum with light and thereby form an electrostatic latent image;

a development device configured to cause toner to adhere to the electrostatic latent image and thereby generate a toner image; and a controller configured to control the exposure device;

wherein the exposure device irradiates a real latent image line position with the light scanning in a primary scanning direction and thereby forms an electrostatic latent image at the real latent image line position, and irradiates two real latent image line positions with the light scanning in a primary scanning direction and thereby forms an electrostatic latent image at an imaginary latent image line position between the two real latent image line positions; and the controller adjusts light emitting time per dot in the exposure device for the real latent image line positions irradiated to form the electrostatic latent image at the imaginary latent image line position, on the basis of a development potential difference corresponding to a development bias voltage of the development device that has been adjusted in calibration and a surface potential of an exposure area on the photoconductor drum.

2. The image forming apparatus according to claim 1, wherein the controller derives a correction amount corresponding to the development potential difference, and adjusts the light emitting time on the basis of the correction amount.

3. The image forming apparatus according to claim 1, wherein the controller determines an electric charge amount of the toner, and adjusts the light emitting time on the basis of the electric charge amount.

4. The image forming apparatus according to claim 1, wherein the controller adjusts the light emitting time on the basis of the development potential difference corresponding to the development bias voltage and the surface potential corresponding to an applied voltage to a light source of the exposure device adjusted in the calibration.

* * * * *